US010064442B2

(12) United States Patent
Morizot

(10) Patent No.: US 10,064,442 B2
(45) Date of Patent: Sep. 4, 2018

(54) HOOD FOR REMOVAL OF A DRIVER'S HELMET

(71) Applicant: STAND 21, Talant (FR)

(72) Inventor: Yves Morizot, Val Suzon (FR)

(73) Assignee: STAND 21, Talant (FR)

( * ) Notice: Subject to any disclaimer, the term of this patent is extended or adjusted under 35 U.S.C. 154(b) by 197 days.

(21) Appl. No.: 15/032,738

(22) PCT Filed: Oct. 28, 2014

(86) PCT No.: PCT/FR2014/000231

§ 371 (c)(1),
(2) Date: Apr. 28, 2016

(87) PCT Pub. No.: WO2015/063379

PCT Pub. Date: May 7, 2015

(65) Prior Publication Data

US 2016/0278464 A1 Sep. 29, 2016

(30) Foreign Application Priority Data

Oct. 28, 2013 (FR) ..... 13 60509

(51) Int. Cl.
*A42B 1/04* (2006.01)
*A42B 3/10* (2006.01)
*A42B 3/32* (2006.01)

(52) U.S. Cl.
CPC ..... *A42B 1/041* (2013.01); *A42B 1/046* (2013.01); *A42B 3/105* (2013.01); *A42B 3/328* (2013.01)

(58) Field of Classification Search
CPC ..... A42B 1/041; A42B 1/146; A42B 3/105; A42B 3/238
USPC ..... 2/174, 202, 204, 207
See application file for complete search history.

(56) References Cited

U.S. PATENT DOCUMENTS 3,505,678 A * 4/1970 Key ..... A42B 1/046 2/174
4,462,117 A * 7/1984 Brunelle ..... A42B 1/041 2/202

FOREIGN PATENT DOCUMENTS

JP 2005054300 A 3/2005
WO 2011/047283 A1 4/2011

OTHER PUBLICATIONS

International Search Report dated Feb. 27, 2015 in corresponding PCT/FR2014/000231; 4pgs.
International Preliminary Report dated Oct. 6, 2015 in corresponding PCT/FR2014/000231; 1pg.

* cited by examiner

*Primary Examiner* — Katherine Moran
(74) *Attorney, Agent, or Firm* — Maier & Maier, PLLC

(57) ABSTRACT

A protective hood designed to be worn under a racing driver's helmet and to help in taking off the helmet of said driver under all circumstances, said hood it has at least one removal member secured to the top of the hood and having dimensions such that its free ends extend downwards and are accessible from outside said integral helmet when the latter is worn over said hood, and a holding member secured to each side face of the hood in order to keep the free ends of said removal member in position against the hood and substantially symmetrical with respect to the vertical sagittal plane of said hood.

4 Claims, 1 Drawing Sheet

HOOD FOR REMOVAL OF A DRIVER'S HELMET

FIELD

This invention relates to a driver's helmet designed to be worn under a racing driver's helmet and that makes it possible to facilitate taking off the helmet of said driver.

BACKGROUND ART

In our days, there are many racing sports wherein drivers are subjected during the races to many physical constraints (acceleration and temperature) and high stress conditions.

For this, the latter wear protective clothing such as full-face helmets and racing suit, but also undergarments intended in particular to slow down the rise in temperature of the drivers and to remove their transpiration during the race.

As such, it is known for drivers to wear under their helmet a driver's helmet provided with an opening defining the field of vision of drivers wearing said full-face helmets. In order to make it possible following an accident to remove the helmet of the driver without risking damage to his head, it is also known, as is described in Japanese patent application JP 2005-54300 of 3 Mar. 2005, to provide the protective hoods with side extraction handles secured to one of their ends on each side of said hoods. These extraction handles are sized to be accessible from the outside of the full-face helmet when the latter is placed on top of the hood. Configured as such, said protective handles can be manipulated by third parties in order to assist in taking off the helmet by preserving the head of the driver that has had an accident.

However, one of the main disadvantages of these handles is to not always remain in position when setting the full-face helmet in place. Indeed, during the setting in place of the helmet on the head of the driver wearing a hood with side extraction handles, the latter can become wedged inside said helmet and no longer be accessible from the outside which renders them unusable in the event of an accident. Moreover, the handles can also be positioned skew in such a way that when a third party exerts a traction in order to assist in taking off the helmet, the third party can cause a rotation of the head of the driver and therefore cause irremediable injuries to said driver that has had an accident.

SUMMARY

The purpose of this invention is therefore to overcome the aforementioned disadvantages and to propose a driver's helmet designed to be worn under a racing driver's helmet that is easy to set in place and which makes it possible to assist under all circumstances in taking off the helmet of said driver without risking damaging the head of the latter.

In accordance with the invention, a driver's helmet is therefore proposed arranged to be worn under a helmet of a racing driver's helmet and to make it possible to assist in taking off the helmet of said driver under all circumstances, said hood being remarkable in that it comprises at least one removal member secured to the top of the hood and having dimensions such that its free ends extend downwards and are accessible from outside said integral helmet when the latter is worn over said hood, and a holding member secured to each side face of the hood in order to keep the free ends of said removal member in position against the hood and substantially symmetrical with respect to the vertical sagittal plane of said hood.

Advantageously, each holding member is a strap of which the ends are secured on the associated side face of the hood, said straps being able to allow for the passage of the associated free end of said removal member.

Each holding member is preferably secured at the bottom of the side face of the hood on a zone corresponding to a portion of the neck of the driver under his lower jaw when said hood is worn by the driver.

According to a preferred embodiment, the removal member comprises two extraction handles secured on the top of the hood according to a line contained in the vertical sagittal plane of said hood.

Advantageously, the two extraction handles each include a central tab and two inclined branches coming from one of the ends of said central branch in such a way as to have a global Y shape, said extraction handles being assembled together by the free ends of their respective inclined branches at the same level as said line.

The hood, the removal member and the holding members are preferably made using flame retardant fabric approved for the practice of racing sports and secured via sewing on the hood.

BRIEF DESCRIPTION OF THE FIGURES

Other advantages and characteristics shall appear better in the following description of an embodiment of a driver's helmet according to the invention in reference to the annexed figures wherein.

DETAILED DESCRIPTION

Figure 1:
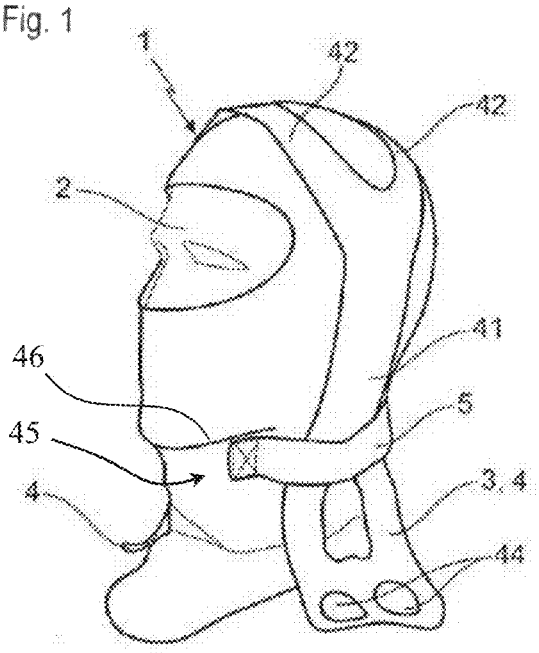
FIG. 1 is a perspective view of a driver's helmet according to the invention set in place on the head of a driver.
Figure 2:
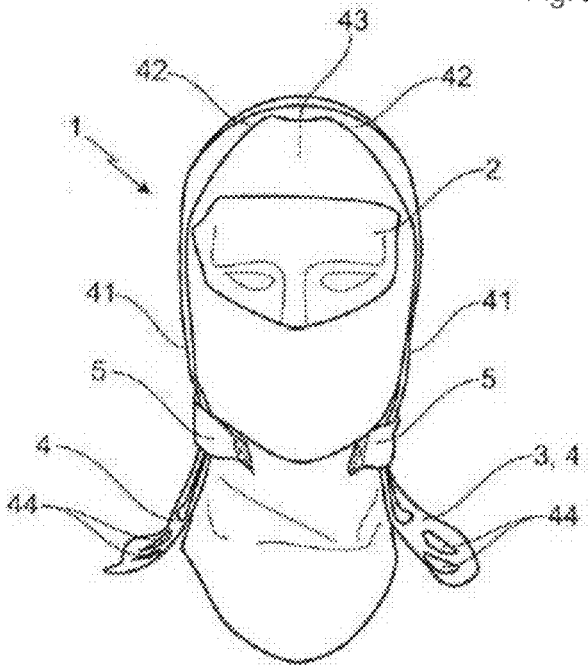
FIG. 2 is a front view of the hood of FIG. 1.

In reference aux FIGS. 1 and 2, the protective hood 1 according to the invention is designed to be worn under a full-face helmet (not shown in the figures) of a racing driver.

Said hood 1 covers at least all of the head and neck of the driver and comprises an opening 2 defining the field of vision of said driver and a removal member 3 advantageously comprising two extraction handles 4 each comprising at least one central tab 41 and two inclined branches 42 coming from one of the ends of said central branch 41 in such a way as to have a global Y shape, said extraction handles 4 being assembled together by the free ends of their respective inclined branches 42 and secured on the top of the hood 1 advantageously according to a line 43 contained in the vertical sagittal plane of said hood 1 (said line 43 is shown as a dotted line in FIG. 2).

The removal member 3 may be made from material and comprise only a single and same element, without leaving the scope of this invention.

The hood 1 and the extraction handles 4 are made from a fabric abler to meet the current standards in the world of racing sports, and in particular standard ISO 15025 A concerning fire resistance.

The assembly together of the extraction handles 4 and their securing onto the hood 1 can be carried out by any suitable technique such as sewing or gluing for example. However, for reasons of resistance to fire, sewing will obviously be favoured.

This removal member 3 has dimensions such that its free ends, corresponding to the free ends of the central branch 41 of each removal handle 4, are accessible from outside the full-face helmet when the latter is worn by the driver on top of said hood 1.

Moreover, each removal handle 4 comprises, at the free end of its central branch 41, at least one and more preferably two orifices 44 allowing for the insertion of the fingers of a third party in order to grasp and correctly manipulate said extraction handles 4 in order to assist in the removal of the helmet without risking damaging the head of the driver that has had an accident.

The Y shape of the extraction handles 4 allows for a more uniform distribution of the effort exerted by said third party on the frontal and parietal regions of the head of the driver that has had an accident during the removal of the helmet.

With such a configuration, it is however well understood that, during the setting in of the full-face helmet, the extraction handles 4 can move, which would have as a consequence a bad positioning of said extraction handles 4 that can injure the driver during the removal of the full-face helmet in the best of cases and a wedging of the extraction handles 4 inside the helmet in the worst of cases, rendering the latter unusable in the event of an accident.

The hood 1 according to the invention therefore comprises a holding member 5 for each one of the extraction handles 4 guaranteeing the correct positioning of the latter and preventing any wedging inside the full-face helmet of the driver when the latter sets said helmet in place on the hood 1.

The two holding members 5 are preferably secured substantially horizontally respectively at the bottom of each one of the side faces of the hood 1 on a zone corresponding to a portion of the neck of the driver under his lower jaw when said hood 1 is worn by the driver. The neck 45 and jaw line 46 of the protective hood is shown in FIG. 1. This position of the holding members 5 makes it possible to maintain the extraction handles 4 thrust along the head and partially the neck of the driver in order to prevent in particular any wedging of said extraction handles 4 inside the helmet during the setting into place. Furthermore, the holding members 5 are such that they limit the displacements of the central branches 41 of the extraction handles 4 and maintain them on either side of the opening 2 symmetrically in relation to the sagittal plane of the hood 1 in order to limit any risk of torsion of the neck of the driver during the removal of his full-face helmet. As such, the extraction handles 4 are substantially maintained in a frontal plane passing at the same level as the ears of the driver when the latter wears the hood 1, which has for consequence to prevent any rotation of the head of the driver when a third party exerts a traction in order to assist with removing the helmet.

The two holding members 5 are advantageously straps of which the ends are secured onto the side face associated with the hood 1, said straps being able to allow for the passage of the central branch 41 of the extraction handles 4. The holding members 5 are made from a fabric able to meet the current standards in the world of racing sports, and in particular standard ISO 15025 A concerning fire resistance. The securing of each holding member 5 on the hood 1 can be carried out by any suitable technique such as sewing or gluing for example. However, for reasons of resistance to fire, sewing will obviously be favoured.

Another characteristic of the hood 1 according to the invention is that the holding members 5 make it possible, in the event of a problem and in the same movement, to remove not only the helmet but also said hood 1 from the driver. This characteristic can be very interesting when the driver has to be ventilated following his accident.

POSSIBILITY OF INDUSTRIAL APPLICATION

The protective hood 1 according to the invention applies more particularly to racing drivers, but it can also be used for any type of person wearing a protective full-face helmet.

Finally, it goes without saying that the examples of the aeration system 1 in accordance with the invention that have just been described are only particular illustrations, and in no cast limit the invention.

The invention claimed is:

1. A protective hood arranged to be worn under a racing driver's helmet to assist in the removal of the helmet under all circumstances, the protective hood comprising:

at least one removal member secured only on a top of the protective hood and having dimensions such that its free ends extend downward and are accessible from outside the racing driver's helmet when the latter is worn over the protective hood, and a holding member in order to keep the free ends of the removal member in position against the protective hood and substantially symmetrical with respect to a vertical sagittal plane of the protective hood, and each holding member being a strap of which the ends are secured to the protective hood at a bottom of a side face of the protective hood, at a location on a neck and under a jaw line portion of the protective hood, the straps being suitable for allowing for the passage of the associated free end of the removal member.

2. The protective hood according to claim 1, wherein the removal member comprises two extraction handles secured on the top of the protective hood along a line contained in the vertical sagittal plane of the protective hood.

3. The protective hood according to claim 2, wherein the two extraction handles each comprise a central branch and two inclined branches coming from one of the ends of the central branch in such a way as to have a global Y shape, the extraction handles being assembled together by the free ends of their respective inclined branches at the same level as the line.

4. The protective hood according to claim 1, wherein the protective hood, the removal member and the holding members are made using a flame retardant fabric and are secured via sewing on the protective hood.

* * * * *